US008316950B2

(12) United States Patent
Rodriguez et al.

(10) Patent No.: US 8,316,950 B2
(45) Date of Patent: Nov. 27, 2012

(54) SYSTEMS AND METHODS FOR DELIQUIFYING A COMMINGLED WELL USING NATURAL WELL PRESSURE

(75) Inventors: Alejandro Rodriguez, Houston, TX (US); Karl Fuchs, New Braunfels, TX (US)

(73) Assignee: BP Corporation North America Inc., Houston, TX (US)

( * ) Notice: Subject to any disclaimer, the term of this patent is extended or adjusted under 35 U.S.C. 154(b) by 344 days.

(21) Appl. No.: 12/780,260

(22) Filed: May 14, 2010

(65) Prior Publication Data

US 2010/0294506 A1 Nov. 25, 2010

Related U.S. Application Data

(60) Provisional application No. 61/180,217, filed on May 21, 2009.

(51) Int. Cl.
*E21B 43/00* (2006.01)
*E21B 34/00* (2006.01)

(52) U.S. Cl. ..... 166/372; 166/369; 166/54.1

(58) Field of Classification Search ..... 166/369, 166/372, 373, 54.1, 325
See application file for complete search history.

(56) References Cited

U.S. PATENT DOCUMENTS

| | | | | |
|---|---|---|---|---|
| 2,247,023 | A | 6/1941 | Humason et al. | |
| 3,199,592 | A | 8/1965 | Jacob | |
| 3,746,089 | A | 7/1973 | Vencil | |
| 3,894,583 | A | 7/1975 | Morgan | |
| 4,460,048 | A | 7/1984 | Smith et al. | |
| 4,515,225 | A * | 5/1985 | Dailey | 175/40 |
| 5,915,478 | A | 6/1999 | Brown et al. | |
| 6,119,780 | A * | 9/2000 | Christmas | 166/313 |
| 2002/0182089 | A1 | 12/2002 | Marvel et al. | |

FOREIGN PATENT DOCUMENTS

WO 01/65062 A2 9/2001

OTHER PUBLICATIONS

PCT Notification of Transmittal of the International Search Report and the Written Opinion of the International Searching Authority, or the Declaration, issued in related application No. PCT/US2010/034906, mailed Jan. 28, 2011, 18 pages.

* cited by examiner

*Primary Examiner* — Brad Harcourt
(74) *Attorney, Agent, or Firm* — Barbara A. Fisher

(57) ABSTRACT

A method for removing fluids from a commingled well comprises positioning a fluid removal system in the well. In addition, the method comprises sealing a first formation from a second formation, shutting in the annulus, and closing off an inner flow passage of a tubing string. Further, the method comprises allowing the pressure of the first and second production zones to build up naturally. Still further, the method comprises flowing a fluid from the first production zone through a first of a plurality of check valves into the inner flow passage, and flowing a fluid from the second production zone through a second of the plurality of check valves into the inner flow passage. Moreover, the method comprises re-opening the inner flow passage of the tubing string and lifting the fluid in the inner flow passage to the surface.

19 Claims, 4 Drawing Sheets

SYSTEMS AND METHODS FOR DELIQUIFYING A COMMINGLED WELL USING NATURAL WELL PRESSURE

CROSS-REFERENCE TO RELATED APPLICATIONS

This application claims benefit of U.S. provisional application Ser. No. 61/180,217 filed May 21, 2009, and entitled "Method and System for Deliquifying a Commingled Well," which is hereby incorporated herein by reference in its entirety for all purposes.

STATEMENT REGARDING FEDERALLY SPONSORED RESEARCH OR DEVELOPMENT

Not applicable.

BACKGROUND

1. Field of the Invention

The invention relates generally to the field of oil and gas production. More particularly, the invention relates to a method of deliquifying a well to enhance production.

2. Background of the Technology

Geological structures that yield gas typically produce water and other liquids that accumulate at the bottom of the wellbore. The liquids can come from condensation of hydrocarbon gas (condensate) or from interstitial water in the reservoir. In either case, the higher density liquid-phase, being essentially discontinuous, must be transported to the surface by the gas.

In some hydrocarbon producing wells that produce both gas and liquid, the formation gas pressure and volumetric flow rate are sufficient to lift the produced liquids to the surface. In such wells, accumulation of liquids in the wellbore generally does not hinder gas production. However, in the event the gas phase does not provide sufficient transport energy to lift the liquids out of the well (i.e. the formation gas pressure and volumetric flow rate are not sufficient to lift the produced liquids to the surface), the liquid will accumulate in the wellbore.

In many cases, the hydrocarbon well may initially produce gas with sufficient pressure and volumetric flow to lift produced liquids to the surface, however, over time, the produced gas pressure and volumetric flow rate decrease until they are no longer capable of lifting the produced liquids to the surface. The accumulation of liquids in the well impose an additional back-pressure on the formation and may begin to cover the gas producing portion of the formation, thereby restricting the flow of gas, thereby restricting the flow of gas and detrimentally affecting the production capacity of the well. Once the liquid will no longer flow with the produced gas to the surface, the well will eventually become "loaded" as the liquid hydrostatic head begins to overcome the lifting action of the gas flow, at which point the well is "killed" or "shuts itself in." Thus, the accumulation of liquids such as water in a natural gas well tends to reduce the quantity of natural gas which can be produced from a given well. Consequently, it may become necessary to use artificial lift techniques to remove the accumulated liquid from the wellbore to restore the flow of gas from the formation.

There are several methods for removing liquids from a gas well. One method of removing liquid from a gas well is to blow the well down to a lower surface pressure, such as atmospheric pressure or the pressure in a storage tank. This may be done following a shut-in to allow the well downhole pressure to build up to a value sufficient to overcome the liquid hydrostatic head, whereupon the well will again flow and produce both gas and liquid to the surface. However, the well may only flow and produce gas and liquid to the surface until the accumulation of liquid once again produces a hydrostatic head sufficient to overcome the produced gas pressure and volumetric flow, at which point the well shuts itself in once again. Further, for some wells (e.g., very low pressure gas wells), the pressure build-up during shut-in may still be insufficient to overcome the liquid hydrostatic head.

Another common method for removing liquids from a gas well with insufficient bottom hole pressure, is to run a relatively small diameter siphon string into the well, close in the annulus between the siphon string and the casing, and periodically open the siphon string to atmospheric pressure. Typically, siphon strings for such application have a diameter of about 1 in. to 1.25 in. The purpose of the small diameter siphon string is to reduce the production flow area, thereby increasing gas flow velocity through the string, which may carry some of the liquids to the surface. This method is particularly applicable to low volume gas wells where a reduced production rate due to increased flowing friction is not a significant problem. This relatively simple solution results in the continuous production of both gas and liquid through the same producing string.

An alternative method employing a small diameter siphon tubing string is to produce gas up the annulus between the tubing string and the casing, and periodically unloading accumulated liquids by either swabbing the well or using a pump as a mechanical artificial lift to lift the liquids up the tubing while the gas flows up the casing. Accumulated liquids may also be removed through a siphon string by forcing liquids and gas up the siphon string by periodically subjecting the annulus between the tubing string and the casing to a relatively high pressure.

Differential pressure intermitters have also been used to unload gas wells. These devices measure the pressure differential between the siphon string and the annulus between the siphon string and casing, determine the amount of water in the siphon tubing string, and blow the well when an adequate load of water is detected. Gas is produced through the annulus, and is slowly bled from the siphon string to cause water in the wellbore to move into the siphon string. The pressure difference between the siphon string and the annulus determines the amount of water in the siphon string. However, the efficiency of the differential pressure intermitter is dependent upon the bleed rate. If the bleed rate is too slow, liquids will build up in the casing. If the bleed rate is too fast, unnecessary amounts of gas are bled from the siphon string and wasted to the atmosphere.

Yet another method for removing liquids from a well involves the use of a plunger, a free moving rod (bluff object) or sealed tube with tight fit or with loose-fitting (pads) seals to prevent fluid bypassing between the plunger and the production tubing wall. The basic operation of a plunger is to open and close the well shutoff/sales valve at the optimum times, to bring up the plunger and the fluids and/or solids that build downhole. Specifically, the plunger is left at the bottom of the well until sufficient pressure has built up to allow the plunger to rise to the top of the well head, pushing the accumulated fluid ahead of the plunger. When the shutoff valve is closed, the pressure at the bottom of the well usually builds up slowly over time as fluids and gas pass from the formation into the well. When the shutoff valve is opened, the pressure at the well head is lower than the bottomhole pressure, so that the pressure differential causes the plunger to travel to the surface. In some instances it is desirable to leave the shutoff valve open for a period of time after the plunger has arrived at the surface. This time period is frequently referred to as "afterflow."

Downhole pumps can also be employed. In these installations, liquid in the well is pumped to the surface through the tubing and gas is produced up the annulus between the tubing and casing. Downhole pumps can be used to continue production in wells where the abandonment pressure is considered to be between 30 and 50 psi at the surface. Downhole pumping means are conventionally employed with wells which have been logged off and which can no longer be unloaded with siphon strings or intermitters. A typical downhole pumping unit comprises an electric motor, a pump, rods and other ancillary equipment.

Although there are several conventional methods for removing liquids from a well, few, if any, of the current methods provide an efficient means for removal of liquid from wells with multiple production formations or zones. Presently, production of commingled wells typically calls for merely using perforated tubing at the site of the upper formations or opening a sliding sleeve to give access to the upper formations but hindering the lower zone production because the tubing integrity below the perforations or sliding sleeve is lost, liquids from upper zones fall onto the lower zone further liquid loading the well, and the critical velocity below the perforation or sliding sleeve changes to that of the casing size which is much higher and unattainable by the lower zone. Such methods may cause interference and cross flow of the upper formation production with the lower formation production and, thus, affect overall productivity of the well. In addition, some of the above described methods may be cost prohibitive in times where the market value of gas is relatively low.

Consequently, there is a need for a simple and cost efficient systems and methods for removing liquid from a well using the well's own natural formation pressure and gas flow, including multi-formation wells.

BRIEF SUMMARY OF THE DISCLOSURE

These and other needs in the art are addressed in one embodiment by a method for removing fluids from a commingled well extending through a formation with a first production zone and a second production zone spaced apart from the first production zone. In an embodiment, the method comprises (a) positioning a fluid removal system in the commingled well, wherein the system has a longitudinal axis, an upper end proximal the surface, and a lower end opposite the upper end and positioned in the commingled well. The system comprises a tubing string extending between the upper end and the lower end and having an inner flow passage extending between the upper end and the lower end, and a plurality of check valves coupled to the tubing string. Each check valve allows one-way fluid flow from an annulus formed between the tubing string and the formation to the inner flow passage of the tubing string. In addition, the method comprises (b) sealing the first formation from the second formation in the annulus. Further, the method comprises (c) shutting in the annulus at the surface. Still further, the method comprises (d) closing off the inner flow passage of the tubing string at the upper end for a period of time. Still further, the method comprises (d) allowing the pressure of the first production zone and the pressure of the second production zone to build up naturally over the period of time. The method also comprises (e) flowing a produced fluid from the first production zone through a first of the plurality of check valves into the inner flow passage of the tubing string. Moreover, the method comprises (f) flowing a produced fluid from the second production zone through a second of the plurality of check valves into the inner flow passage of the tubing string. In addition, the method comprises (e) re-opening the inner flow passage of the tubing string at upper end after (d). Further, the method comprises (f) lifting the produced fluid from the first production zone and the produced fluid from the second production zone in the inner flow passage to the surface during (e).

These and other needs in the art are addressed in another embodiment by a system for deliquifying a commingled well, the system having a longitudinal axis, a first end, and a second end opposite the first end. In an embodiment, the system comprises a tubing string defining an inner flow passage extending from the first end to the second end. The tubing string includes a plurality of tubular mandrels. In addition, the system comprises a first packer disposed about the tubing string. Further, the system comprises a plurality of check valves. Each check valve is adapted to allow fluid flow into the inner flow passage. At least one check valve is coupled to each tubular mandrel. Still further, the system comprises a standing valve coupled to the tubing string proximal the second end. The packer is axially positioned between the standing valve and each check valve.

These and other needs in the art are addressed in one embodiment by a method for removing fluids from a commingled well extending through a formation with a first production zone and a second production zone spaced apart from the first production zone. In an embodiment, the method comprises (a) positioning a production tubing system in the commingled well. The production tubing system extends along a longitudinal axis between a first end and a second end opposite the first end. The system comprises an elongate tubing string with an inner flow passage, a plurality of axially spaced check valves coupled to the tubing string, and a first packer disposed about the tubing string. In addition, the method comprises (b) forming an annulus between the production tubing system and the formation. Further, the method comprises (c) positioning the packer between the first production zone and the second production zone. Still further, the method comprises (d) radially expanding the packer to dividing the annulus into an upper annulus section disposed above the packer and a lower annulus section disposed below the packer, the packer sealing the upper annulus section from the lower annulus section. Moreover, the method comprises (e) closing off the annulus and the inner flow passage at the first end for a period of time. The method also comprises (f) flowing a first fluid from the first production zone into the upper annulus section, the first fluid in the upper annulus section having a first pressure. In addition, the method comprises (g) flowing a second fluid from the second production zone into the lower annulus section, the second fluid in the lower annulus section having a second pressure. Further, the method comprises (h) allowing the first pressure and the second pressure to increase naturally during (e). Still further, the method comprises (i) re-opening the tubing string at the first end. Moreover, the method comprises (j) using the first pressure to flow the first fluid through a first of the check valves into the inner flow passage and using the second pressure to flow the second fluid through a second of the check valves into the inner flow passage.

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF SOME OF THE PREFERRED EMBODIMENTS

Figure 1:
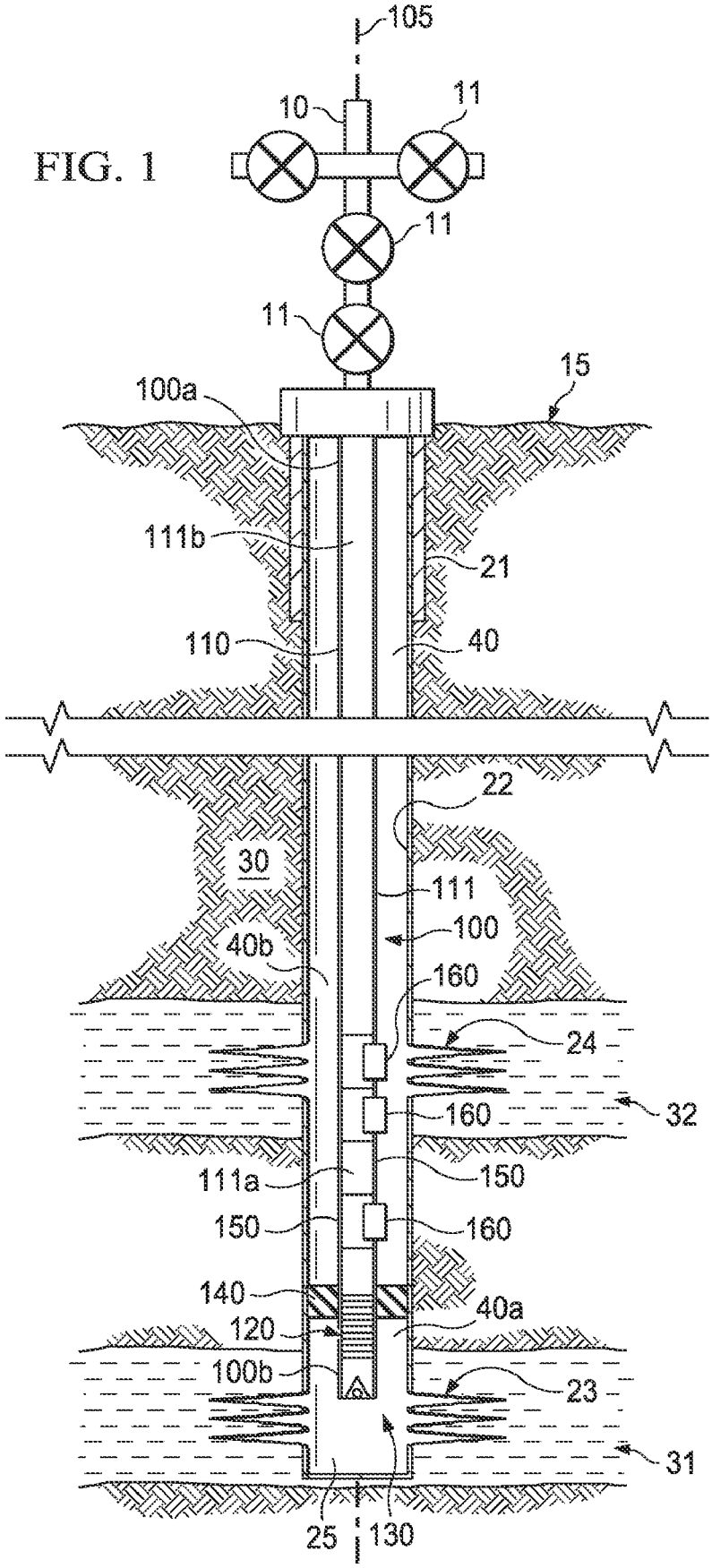
FIG. 1 is a cross-sectional schematic view of an embodiment of a system for deliquifying a commingled well.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Referring now to FIG. 1, an embodiment of a deliquification system 100 in accordance with the principles described herein is shown extending from a wellhead 10 at the surface 15 into a wellbore 20 through surface casing 21 and production casing 22. Wellbore 20 traverses an earthen formation 30 comprising a plurality of production zones. In particular, formation 30 includes two production zones—a first or lower production zone 31 and a second or upper production zone 32 positioned above first production zone 31. Since wellbore 20 includes multiple production zones, it may also be referred to as a "commingled well." Thus, as used herein the term "commingled well" refers to an oil and/or gas well that contains a plurality of hydrocarbon producing formations or production zones. As used herein, the phrases "production zone" and "producing formation" refer to hydrocarbon producing formations that may be physically separated or separate, spaced apart intervals within a single, relatively large pay zone. In other words, two or more spaced apart production zones may actually be part of and/or produce from a single, relatively large pay zone.

Although formation 30 includes two production zones 31, 32, in general, embodiments disclosed herein (e.g., system 100) may be used in conjunction with commingled wells having any number of production zones (e.g., 3 or 4 production zones), or used with wells having only one production zone.

Production casing 22 includes perforations 23, 24 arranged at different depths from the surface 15. Perforations 23 are axially aligned with lower production zone 31, and perforations 24 are axially aligned with upper production zone 32. In other words, perforations 23, 24 are opposed production zones 31, 32, respectively. Perforations 23, 24 are holes or passages through production casing 22 that allows fluid communication between an annulus 40 formed radially between system 100 and casing 21, 22. Thus, perforations 23, 24 allow oil, gas, and other fluids (e.g., water) to flow from production zones 31, 32 into annulus 40.

Referring still to FIG. 1, system 100 has a central or longitudinal axis 105, a first or upper end 100*a* coupled to wellhead 10 and a second or lower end 100*b* extending to accumulated liquids 22 in wellbore 20. As previously described, annulus 40 is formed radially between system 100 and casings 21, 22. Wellhead 10 includes a plurality of valves 11 that regulate and control the flow of fluids into and out of annulus 40 and system 100 at the surface 15.

System 100 comprises an elongate production tubing string 110 extending between ends 100*a*, b, a plunger 120 disposed in tubing string 110, a standing valve 130 disposed at lower end 100*b*, and at least one packer 140 disposed about tubing string 110 and axially positioned between ends 100*a*, b. A plurality of tubular mandrels 150 are positioned in tubing string 110, each mandrel including a check valve 160. As will be explained in more detail below, system 100 may be employed to (a) remove and lift accumulated liquids from wellbore 20 to the surface 15 to enhance the recovery of gas from wellbore 20; (b) isolate production zones 31, 32; (c) flow fluids from both production zones 31, 32 through a common, single tubing string 110; and (d) separately treat and/or clean production zones 31, 32.

Together, tubing string 110 and mandrels 150 define a continuous, radially inner flow passage 111 extending axially from wellhead 10 to proximal the bottom of the commingled wellbore 10. One of the wellhead valves 11 at the surface 15 controls and regulates the flow of fluids through tubing string 110 and flow passage 111 at upper end 100*a*. As will be described in more detail below, during operation of system 100, through passage 111 provides a conduit to flow accumulated liquids and produced fluids from wellbore 10 to the surface 15.

Tubing string 110 may comprise any suitable tubular conduit or pipe including, without limitation, steel tubing, metal tubing, coiled tubing, flexible tubing, non-metallic tubing, fiberglass, polyliner, etc. Although tubing string 110 may have any suitable diameter, for most applications, tubing string 110 preferably has an inner diameter ranging from 0.1 in. to 12 in., more preferably ranging from 1 in. to 6 in., and even more preferably ranging from 2 in. to 4 in.

Referring still to FIG. 1, standing valve 130 allows fluids to flow into tubing string 110 and passage 111 at lower end 100*b*. However, standing valve 130 restricts and/or prevents the backflow of fluids in passage 111. Specifically, standing valve 130 has an "open" position in which fluid in the lower portion of wellbore 20 proximal standing valve 130 is free to flow through valve 130 and into passage 111, and a "closed" position in which fluid communication between the lower portion of wellbore 20 and passage 111 through standing valve 130 is restricted and/or prevented. Thus, standing valve 130 is a check valve that allows one-way fluid flow into passage 111. As used herein, the term "check valve" refers to a mechanical device or valve that allows fluid (i.e., liquid or gas) to flow therethrough in only one direction.

The transition of standing valve 130 between the open and closed position occurs at a pre-determined pressure differential across standing valve 130 (i.e., the pressure differential between passage 111 proximal standing valve 130 and the lower portion of wellbore 20 proximal standing valve 130), referred to as the pre-determined transition pressure differential or "cracking pressure." More specifically, when the pressure in the lower portion of wellbore 20 proximal valve 130 minus the pressure in passage 111 proximal valve 130 is equal to or greater than the cracking pressure of valve 130, valve 130 transitions to the open position. Valve 130 will remain in the open position as long as the pressure in wellbore 20 proximal valve 130 exceeds the pressure in passage 111 proximal valve 130 by an amount equal to or greater than the cracking pressure of valve 130. However, when the pressure in wellbore 20 proximal valve 130 minus the pressure in passage 111 proximal valve 130 is less than the cracking pressure of valve 130, valve 130 transitions to the closed position. Valve 130 will remain in the closed position as long as the pressure in wellbore 20 proximal valve 130 minus the pressure in passage 111 proximal valve 130 is less than the cracking pressure of valve 130.

Standing valve 130 is preferably a relatively low pressure one-way check valve. In other words, standing valve 130 preferably transitions between the closed and open positions at a relatively low cracking pressure. In particular, the cracking pressure of standing valve 130 is preferably less than or equal to 100 psi, more preferably less than or equal to 50 psi, more preferably less than or equal to 25 psi, more preferably less than or equal to 10 psi, and even more preferably less than or equal to 1 psi. In general, the purpose of standing valve 130 is to allow fluids to enter production tubing 110 from the bottom of wellbore 20 with minimal resistance while preventing fluids within production tubing 110 from escaping into the lower portion of wellbore 20.

In this embodiment, standing valve 130 is positioned at the lower end 100*b*. Thus, standing valve 130 is specifically positioned to receive accumulated fluids 22 and produced fluids from production zone 31 in the bottom of wellbore 10. Although the standing valve (e.g. standing valve 130) may be positioned at other suitable locations along the tubing string (e.g., tubing string 110), the standing valve is preferably positioned at the lower end of the tubing string (e.g., at lower end 100*b*) to receive accumulated fluids in the lower section of the wellbore (e.g., bottom of wellbore 20).

As shown in FIG. 1, standing valve 130 is a stationary ball check valve. However, in general, the standing valve (e.g., standing valve 130) may comprise any suitable valve that allows one-way fluid flow into the tubing string (e.g., tubing string 111).

Although standing valve 130 is shown and described as a check valve that only allows one-way fluid communication into tubing string 110, in other embodiments, the standing valve at the lower end of the tubing string (e.g., standing valve 130 at lower end 100*b*) may be replaced with an open port that is in fluid communication with the inner passage of the tubing string (e.g., passage 111 of tubing string 110) and the portion of the wellbore and annulus at the lower end of the tubing string (e.g., the portion of wellbore 20 and annulus 40 below lower end 100*b*). Still further, in other embodiments, the standing valve (e.g., standing valve 130) may be replaced by a "bypass check valve," which operates similar to a normal check valve except that it allows a small amount of leaking fluid or gas to backflow from the tubing string back into the wellbore to clean the valve orifice.

Figure 2:
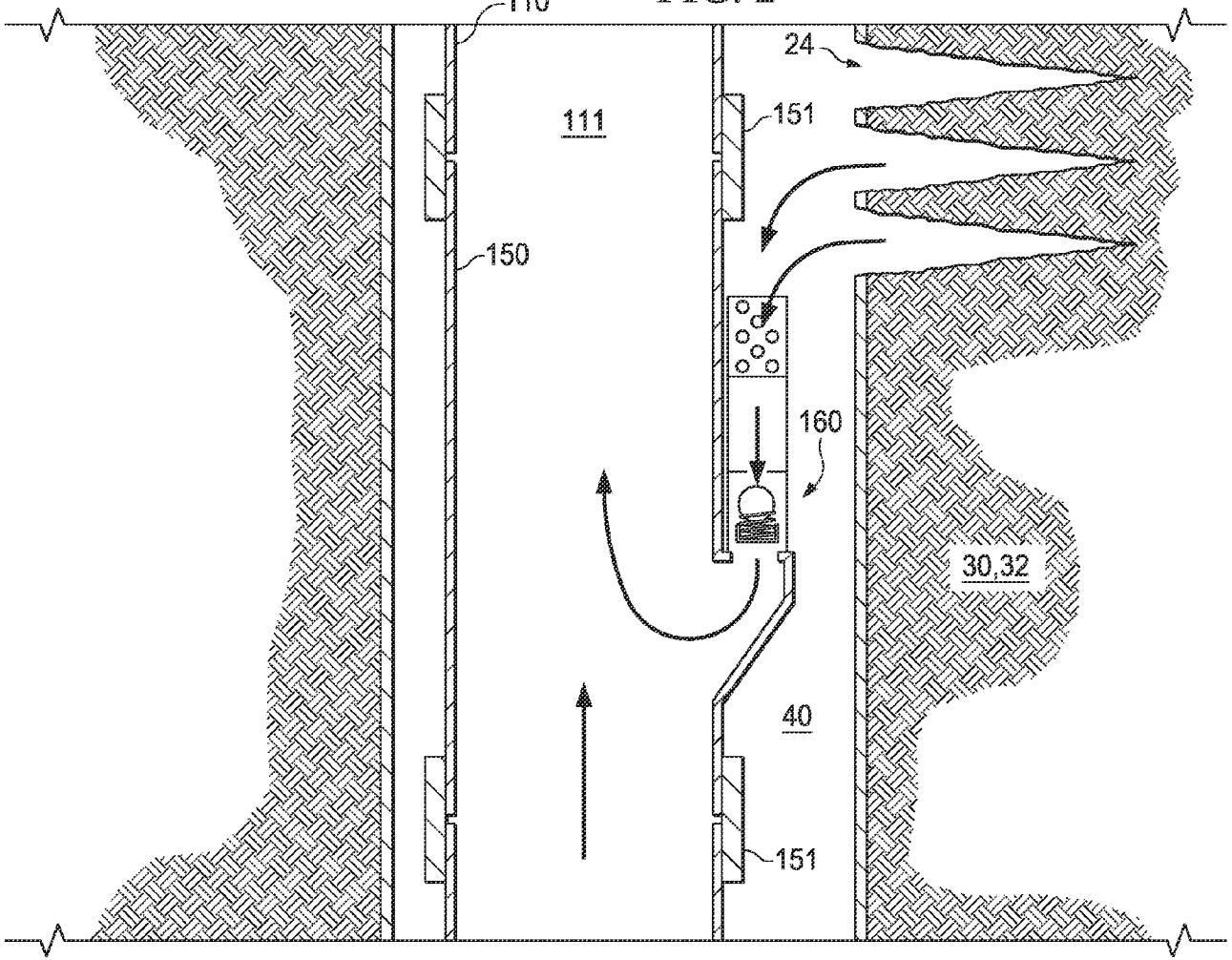
FIG. 2 is an enlarged view of one of the valves of the system of FIG. 1.

Referring now to FIGS. 1 and 2, mandrels 150 are specialized tubular component coupled to production tubing string 110 with annular collars 151. As best shown in FIG. 2, each mandrel 150 includes an inlet port or opening 152. In this embodiment, each inlet port 152 is formed in a side pocket that is radially offset from the central through bore of its respective mandrel 150. However, in general, the mandrels (e.g., mandrels 150) may have any suitable geometry and the inlet port of each mandrel (e.g., inlet port 152 of each mandrel 150) may be located at other suitable locations. Examples of suitable mandrels are disclosed in U.S. Pat. No. 4,480,686, which is hereby incorporated herein by reference in its entirety. Further, one or more of the mandrels may be, for example, a tubing-retrievable mandrel or a side-pocket wireline-retrievable mandrels. Although only one mandrel 150 is shown in FIG. 2, remaining mandrels 150 shown in FIG. 1 are similarly configured.

One check valve 160 is coupled to inlet port 152 of each mandrel 150, and regulates the flow of fluids through port 152. In general, each check valve 160 may be coupled to its respective mandrel by any suitable means including, without limitation, mating threads, interference fit, welded connection, bolts, or combinations thereof. However, as will be described in more detail below, check valves 160 are preferably removably coupled to mandrels 150 so that check valves 160 may be easily removed from mandrels 150 and tubing string 110 for service, maintenance, and/or cleaning In the embodiment shown in FIG. 2, check valve 160 is threadingly engages inlet port 152 of mandrel 150.

Each check valve 160 has an "open" position in which fluid in annulus 40 proximal the check valve 160 is free to flow through valve 160 and inlet port 152 into mandrel 150 and passage 111, and a "closed" position in which fluid communication between annulus 40 and passage 111 through valve 160 and inlet port 152 is restricted and/or prevented. Thus, each check valve 160 allows one-way fluid flow from annulus 40 into passage 111.

The transition of each check valve 160 between the open and closed position occurs at a cracking pressure or predetermined pressure differential across the check valve 160 (i.e., the pressure differential between annulus 40 proximal the check valve 160 and passage 111 proximal the check valve 160). When the pressure in annulus 40 proximal valve 160 minus the pressure in passage 111 proximal valve 160 is equal to or greater than the cracking pressure of valve 160, valve 160 transitions to the open position. Valve 160 will remain in the open position as long as the pressure in annulus 40 proximal valve 160 exceeds the pressure in passage 111 proximal valve 160 by an amount equal to or greater than the cracking pressure. However, when the pressure in annulus 40 proximal valve 160 minus the pressure in passage 111 proximal valve 160 is less than the cracking pressure of valve 160, valve 160 transitions to the closed position. Valve 160 will remain in the closed position as long as the pressure in annulus 40 proximal valve 160 minus the pressure in passage 111 proximal valve 160 is less than the cracking pressure.

Each check valve 160 is preferably a relatively low pressure one-way check valve. In other words, each check valve 160 preferably transitions from the closed position to the open position at a relatively low cracking pressure. In particular, the cracking pressure of each check valve 160 is preferably less than or equal to 100 psi, more preferably less than or equal to 50 psi, more preferably less than or equal to 25 psi, more preferably less than or equal to 10 psi, and even more preferably less than or equal to 1 psi. Each check valve may have the same cracking pressure, or alternatively, two or more of the check valves may have different cracking pressure. In general, the purpose of each check valve 160 is to allow fluids to enter production tubing 110 from annulus 40 with minimal resistance while preventing fluids within production tubing 110 from escaping into annulus 40.

As shown in FIG. 2, check valve 160 is a ball check valve, however, in general, the check valves (e.g., check valves 160) may comprise any suitable type of check valve. For example, one or more of the check valves may be a ball check valve, a diaphragm check valve, a swing check valve, a clapper valve, a stop-check valve, a lift-check valve, etc. It should be appreciated that check valves 160 employed in system 100 are different than gas-lift valves used in an artificial gas-lift applications. Specifically, gas-lift valves typically require a relatively high cracking pressure before opening, whereas each check valve 160 in the system 100 is designed to have a relatively low cracking pressure as previously described to allow easy entry of formation fluids into tubing string 110.

Referring now to FIG. 2, in this embodiment, a debris filter or screen 161 is coupled to each check valve 160. Screen 161 is positioned upstream of check valve 160 relative to the one-way fluid flow from annulus 40 into passage 111 through valve 160, and functions to restrict and/or prevent relatively large solids and well debris from entering and clogging check valve 160.

Referring again to FIG. 1, in this embodiment, three mandrels 150 and three associated check valves 160 are provided in system 100. In particular, two mandrels 150 and associated check valves 160 are positioned along tubing string 110 proximal production zone 32 (i.e., radially adjacent production zone 32), and one mandrel 150 and associated check valve 160 is positioned proximal, and axially above, packer 140. In such an arrangement, the two upper check valves 160 proximal production zone 32 are position to receive fluids entering annulus 40 from the adjacent production zone 32 through perforations 24, and the lower check valve 160 is positioned to receive fluids in annulus 40 that accumulate above packer 140. To enhance the efficiency of system 100, at least one check valve (e.g., standing valve 130 or check valve 160) is preferably provided proximal each production zone (e.g., production zone 31, 32), and at least one check valve (e.g., check valve 160) is preferably provided immediately above of each packer (e.g., packer 140).

Referring still to FIG. 1, packer 140 is disposed about tubing string 110 and axially positioned between production zones 31, 32. Packer 140 is run into wellbore 20 on tubing string 110 with an outer diameter that is less than the diameter of borehole 20, surface casing 21, and production casing 22. Once downhole, packer 140 may be radially expanded to sealingly engage tubing string 110 and production casing 22, thereby isolating the section of annulus 40 axially above packer 140 from the section of annulus 40 axially below packer 140. For purposes of further explanation below, the portion of annulus 40 axially below packer 140 is referred to as lower annulus section 40*a*, and the portion of annulus 40 axially above packer 140 is referred to as upper annulus section 40*b*. In general, packer 140 may comprise any suitable packer known in the art including, without limitation, a packer with flexible, elastomeric elements, a production or test packer, an inflatable packer, or a multiple string flow through design.

Figure 3:
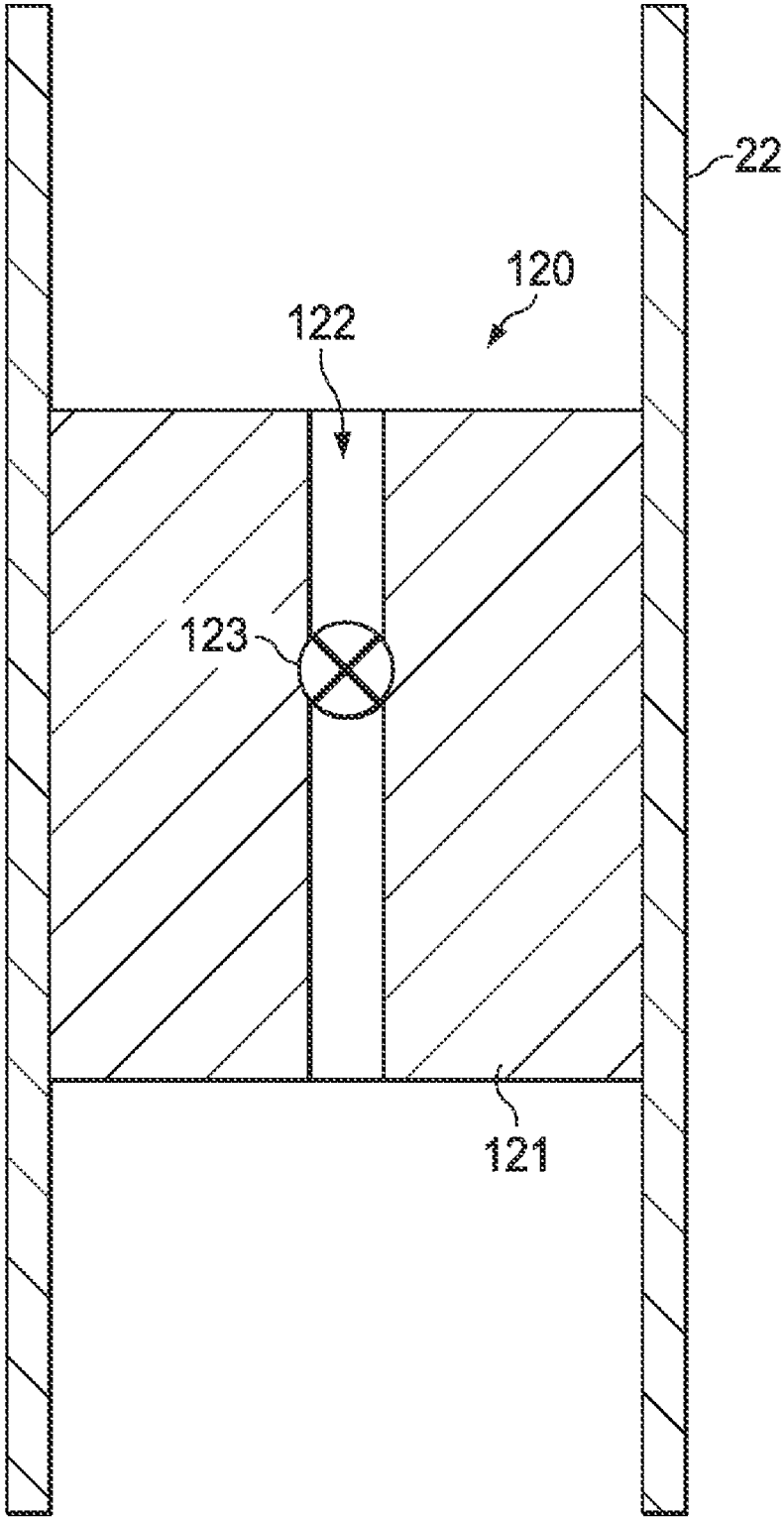
FIG. 3 is an enlarged cross-sectional schematic view of the plunger of FIG. 1.

Referring now to FIGS. 1 and 3, plunger 120 is disposed within passage 111 and functions as a free piston within tubing string 110. As best shown in FIG. 3, plunger 120 comprises a cylindrical body 121, a central through bore 122 extending axially through body 121, and a valve 123 that controls fluid flow through bore 122. Specifically, when valve 123 is in an open position, fluid is free to flow through bore 122, and when valve 123 is in a closed position, fluid is restricted and/or prevented from flowing through bore 122. The radially outer surface of body 121 slidingly engages the radially inner surface of tubing string 110. An annular sealing element may be radially positioned between body 121 and tubing string 110 to form an annular seal therebetween that restricts and/or prevents the axial flow of fluids between body 121 and tubing string 110.

Valve 123 of plunger 120 is preferably configured to open proximal upper end 100*a* and close proximal lower end 100*b*. For example, plunger valve 123 may be operated by a pair of bumpers disposed in tubing string 110—an upper bumper proximal upper end 100*a* triggers valve 123 to open, thereby allowing plunger 120 to fall axially downward through tubing string 110 towards lower end 100*b*; and a lower bumper proximal lower end 100*b* triggers valve 123 to close, thereby restricting and/or preventing fluid flow through bore 122 and isolating the fluid in passage 111 axially below plunger 120 from the fluid in passage 111 axially above plunger 120. When valve 123 is closed, a sufficient fluid pressure in passage 111 axially below plunger 120 will force plunger 120 axially upward through tubing string 110. With valve 123 closed, as plunger 120 ascends axially upward, it lifts and pushes a slug of fluid in passage 111 axially above plunger 120 to the surface 15. In general, plunger 120 may comprise any suitable plunger known in the art. An example of one suitable plunger is described in U.S. Pat. No. 4,211,279, which is hereby incorporated herein by reference in its entirety for all purposes.

Plunger 120 is free to move axially within tubing string 110 from end 100*a* to end 100*b*. In other words, mandrels 150 and check valves 160 do not interfere or restrict the axial movement of plunger 120 through tubing string 110. For purposes of further explanation below, the portion of passage 111 axially below plunger 120 is referred to as lower passage section 111*a*, and the portion of passage 111 axially above plunger 120 is referred to as upper passage section 111*b*.

Although plunge 120 is shown and described as a "bypass plunger" that includes bypass valve 123, in general, any suitable type of plunger known in the art may be used in system 100. For example, in other embodiment, the plunger (e.g., plunger 120) may not include a through bore (e.g., bore 122) or valve (e.g., valve 123).

In general, the components of system 100 (e.g., mandrels 150, plunger 120, check valves 160, standing valve 130) may be fabricated from any suitable material such as metals and metal alloys (e.g., aluminum, steel, etc.), non-metals (e.g., elastomers, ceramics, etc.), or composites (e.g., carbon fiber and epoxy composite, etc.). However, the components of system 100 are preferably fabricated from materials that are corrosion resistant and capable of withstanding the harsh downhole conditions. Examples of suitable materials include, without limitation, polymers, metals, alloys, composites, copolymers, steel, or combinations thereof.

Referring again to FIG. 1, an embodiment of a method for deliquifying commingled well 20 with system 100 will be explained. Typically, deliquification of the well (e.g., wellbore 20) is necessitated by the significantly reduced or ceased hydrocarbon production resulting from accumulation of liquids in the well. Prior to installation of system 100 downhole, the existing production tubing from wellbore 20 is pulled and removed from casing 21, 22. Once the existing tubing is removed, lower end 100*b* of system 100 is inserted into wellbore 20 and casing 21, 22, and system 100 is axially advanced downhole.

System 100 is preferably positioned in wellbore 20 such that packer 140 is axially disposed between production zones 31, 32. In general, one packer (e.g., packer 140) is preferably axially disposed between each pair of adjacent production zones (e.g., production zones 31, 32). In this embodiment, wellbore 20 only traverses two production zones 31, 32, and thus, only one packer 140 is included and disposed between production zones 31, 32. However, as will be described in more detail below, in other embodiments in which the wellbore traverses three or more production zones, two or more packers are should be included, one packer axially positioned between each pair of adjacent production zones.

In general, embodiments described herein (e.g., system 100) are preferably configured such that (a) at least one check valve (e.g., check valves 160) is axially positioned proximal and axially above each packer (e.g., packer 140); (b) the standing valve (e.g., standing valve 130) is positioned axially below the axially lowermost packer; and (c) at least one check valve is positioned proximal (i.e., at a similar depth) each production zone and associated perforations axially above the lowermost packer. Such a configuration enables the check valve proximal and axially above the packer to receive accumulated fluids above the packer; enables each check valve proximal a production zone to receive produced fluids from that particular production zone; and enables the standing valve to receive accumulated fluids in the bottom of the wellbore as well as produced fluids from the production formation positioned axially below the packer. For example, as shown in FIG. 1, check valves 160 are axially spaced along tubing string 110 such that one check valve 160 is positioned proximal and axially above packer 140 to receive fluids that may build up in annulus 140 above packer 140; at least one check valve 160 is positioned proximal perforations 24 and production zone 32 to receive fluids flowing into annulus 40 from production zone 32 via perforations 24; and standing valve 130 is disposed at lower end 100*b* of system 100 and axially below packer 140 to receive accumulated fluids 22 in the bottom of wellbore 20 as well as produced fluids entering annulus 40 from lowermost production zone 31 via perforations 23.

Plunger 120 is coaxially disposed in tubing string 110 with valve 123 opened, and allowed to slide axially downward through passage 111 to lower end 100*b*. As previously described, plunger 120 is configured to close proximal lower end 100*b* and open proximal upper end 100*a*. Thus, when plunger 120 reaches lower end 100*b*, valve 123 closes. Valve 123 remains closed until it is triggered to open when it is pushed back to upper end 100*a* at the surface 15.

With packer 140 and check valves 160 positioned within wellbore 20 relative to production zones 31, 32 as previously described, packer 140 is radially expanded into production casing 22, thereby sealingly engaging tubing string 110 and production casing 22. As a result, packer 140 restricts and or prevents fluid communication between lower annulus section 40*a* and upper annulus section 40*b*, thereby isolating the fluids entering annulus 40 from production zone 31 from the fluids entering annulus 40 from production zone 32.

Referring still to FIG. 1, with packer 140 sealingly engaging tubing string 110 and production casing 22, wellbore 20 is shut in using surface valves 11. In particular, passage 111 is closed off at surface 15 and annulus 40 is closed off at surface 15 if it was not already closed off. Once wellbore 20 is shut-in, the natural pressure of production zones 31, 32 is allowed to build over time. The duration of the well shut-in depends on a number of factors and may vary from well-to-well. For most applications, the shut-in period is preferably between 1 and 128 hours, more preferably between 10 and 36 hours, and even more preferably between 12 and 24 hours. If the pressure of production zone 31 is sufficient to keep running plunger 120 with minimal or no shut-in period, the shut-in period is preferably zero to 30 mins. In other words, in some embodiments, no shut-in is necessary.

The upper annulus section 40*b* is in fluid communication with production formation 32 via perforations 24, and lower annulus section 40*a*, as well as the bottom of wellbore 20, is in fluid communication with production formation 31 via perforations 23. Since lower annulus section 40*a* is sealed by packer 140 during the well shut-in, as the pressure of production zone 31 increases, the pressure in lower annulus section 40*a* and the bottom of wellbore 20 will also increase, thereby urging fluids (e.g., accumulated liquids, water, produced hydrocarbons, etc.) through relatively low cracking pressure standing valve 130 and into tubing string 110. As previously described, standing valve 130 is a one-way check valve, and thus, fluids entering lower passage section 111*a* are restricted and/or prevented from exiting tubing string 110 back through standing valve 130. In addition, since upper annulus section 40*b* is sealed at its upper end with surface 15 with valves 11 and sealed at its lower end with packer 140 during the well shut-in, as the pressure of production zone 32 increases, pressure in upper annulus section 40*b* will also increase, thereby urging fluids through relatively lower cracking pressure check valves 160 into tubing string 110. As previously described, each check valve 160 is a one-way check valve, and thus, fluids entering passage 111 (i.e., upper passage section 111*b* or lower passage section 111*a* depending on the axial position of plunger 120) are restricted and/or prevented from exiting tubing string 110 back through any of check valves 160.

In this embodiment, passage 111 and annulus 40 are both shut-in at the surface 15 during well shut-in period. However, if the upper production zone (e.g., production zone 32) is at a higher pressure than the lower production zone (e.g., production zone 31), the well operator has the option of shutting-in only the tubing string (e.g., passage 111) during the well shut-in period, leaving the annulus (e.g., annulus 40) open at the surface, and flowing fluids from the upper formation up the annulus while simultaneously purging fluids from the upper formation and lower formation through the check valves (e.g., check valves 160) and into the tubing string (e.g., tubing string 110) as previously described.

During the well shut-in, valve 123 of plunger 120 remains closed, and thus, fluid is restricted and/or prevented from flowing axially through bore 122 between upper annulus section 40*b* and lower annulus section 40*a*. Further, as previously described, plunger 120 sealingly engages the inner surface of tubing string 110. Thus, fluid is also restricted from flowing axially between tubing string 110 and plunger 120. In other words, as long as valve 123 of plunger 120 is closed, fluid in upper passage section 111*b* is isolated from fluid in lower passage section 111*a*. However, even when valve 123 is closed, fluid from the production zone 31, 32 can still access passage section 111*a, b*, respectively, as long as the pressure in passage section 111*a, b* is lower than the pressure in annulus section 40*a, b*, respectively.

During the well shut-in, the fluid entering lower passage section 111*a* exerts an axially upward force on plunger 120, thereby urging plunger 120 axially upward. However, these forces and movement are counteracted by the fluid entering upper passage section 111*b*, which exerts an axially downward force on plunger, thereby urging plunger 120 axially downward. During the shut-in period, plunger 120 may move slightly up or down within tubing string 110 until the axially upward forces on plunger 120 resulting from fluids in lower passage section 111*a* are balanced by the axially downward forces on plunger 120 resulting from fluids in upper passage section 111*b*. Although there may be slight upward movement of plunger 120 during well shut-in, valve 123 of plunger 120 remains closed unless or until plunger 120 move axially upward to upper end 100*a* at the surface 15.

In this embodiment, after the shut-in period, tubing string 110 is opened at the surface 15, however, annulus 40 remains shut-in at the surface 15. Once tubing string 110 is opened at upper end 100*a*, the pressure in upper passage section 111*b* is relieved, and thus, the axially downward forces acting on plunger 120 are significantly reduced. As a result, the built-up pressure in lower annulus section 40*a* begins to move plunger 120 axially upward through tubing string 110. In other words, plunger 120 does not move axially within tubing string 110 unless it experiences a pressure differential between passage sections 111*a, b*. When tubing string 110 is shut-in, the pressure differential across plunger 120 will equalize, and thus, axial movement of plunger 120 is minimal. However, once tubing string 110 is re-opened at the surface 15, a pressure differential is immediately created across plunger 120—the pressure in upper passage section 111*b* becomes relatively low compared to the pressure in lower passage section 111*a*. Consequently, plunger 120 will shoot axially upward within tubing string 110.

Simultaneously, the built-up pressure in production zone 31, lower annulus section 40*a*, and the bottom of wellbore 20 (which remain sealed off from upper annulus section 40*b* by packer 140) forces fluid through standing valve 130 and into lower passage section 111*a*, further aiding in the lifting of plunger 120 to the surface 15. As previously described, valve 123 of plunger 120 remains closed until plunger 120 reaches upper end 100*a* and surface 15. Thus, as plunger 120 move axially upward within tubing string 110, it pushes the slug of fluid in upper annulus section 40*b* axially upward to the surface 15.

As previously described, in this embodiment, tubing string 110 and annulus 40 are shut-in during the well shut-in period, and tubing string 110, but not annulus 40, is re-opened at the surface 15 following the well shut-in period. However, as previously described, if the pressure of the upper production zone (e.g., production zone 32) is higher than the lower production zone (e.g., zone 31), the tubing string (e.g., tubing string 110) may be shut-in and re-opened following the shut-in period, however, the annulus (e.g., annulus 40) may remain open when the tubing string is shut-in. This will allow production of the upper production zone through the annulus to the surface during and after the tubing string is shut-in to reduce the potential for choking the lower production zone.

When plunger 120 reaches the surface 15, valve 123 opens. If plunger 120 is not captured at the surface 15 and valve 123 is open, plunger 120 will fall axially downward through tubing string 110 to lower end 100*b*, at which point valve 123 closes, and the process may be repeated. Alternatively, plunger 120 may be captured at surface 15 to allow continued, unrestricted production of fluids (e.g., water, hydrocarbons, condensate, etc.) through tubing string 110 via the natural pressure of production zones 31, 32. Such production from wellbore 20 may continue until liquid build-up kills the well in. Once production through tubing string 110 is sufficiently reduced or ceases, the process may be repeated by releasing plunger 120 into tubing string 110 with valve 123 open, thereby allowing plunger 120 to fall within tubing string 110 to lower end 100*b*, at which point valve 123 closes. Next, tubing string 110 and annulus 40 (if not already closed off) are shut in at the surface 15 with valves 11. During the shut-in, natural reservoir pressure is allowed to build, and then tubing string 110 is opened at the surface 15, and plunger 120 is forced to the surface 15 once again.

Figure 4:
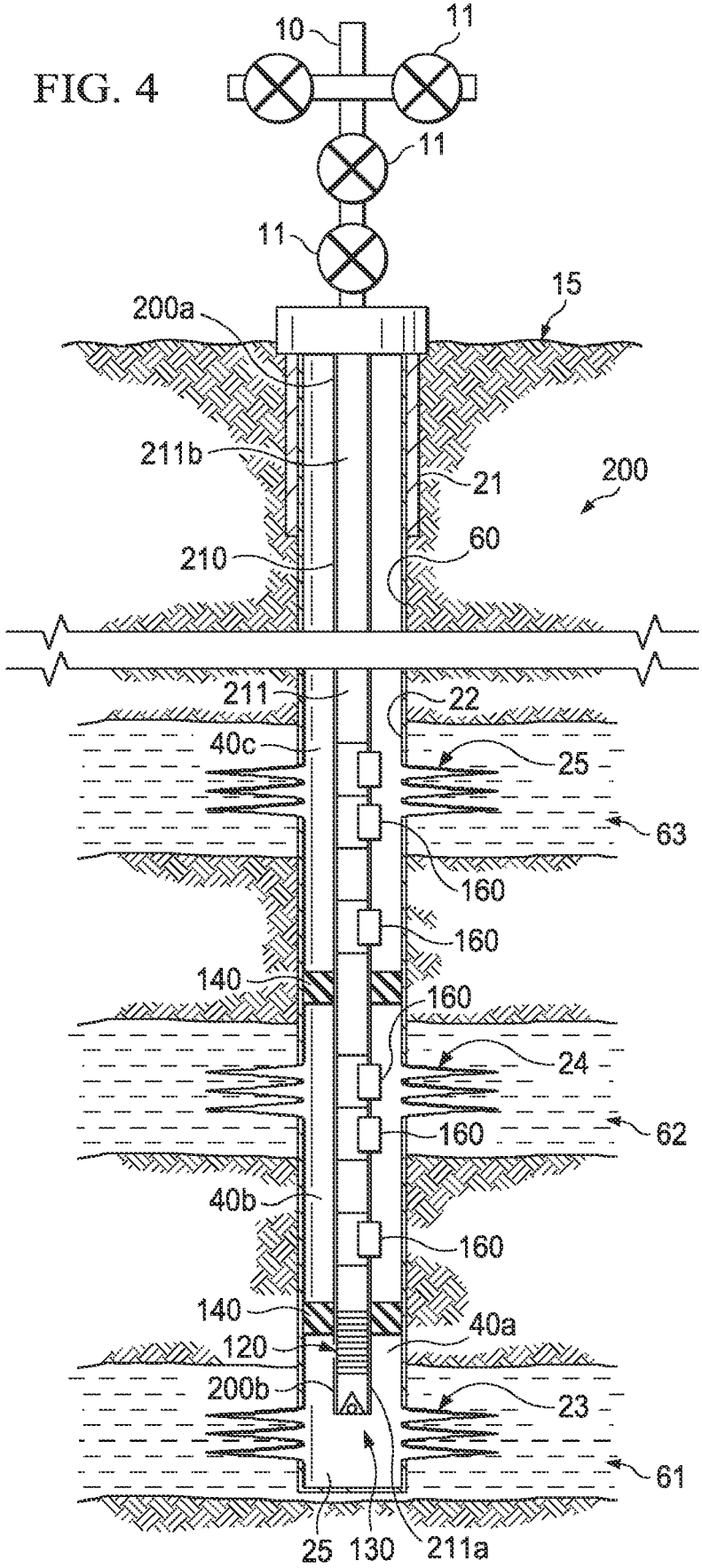
FIG. 4 is a cross-sectional schematic view of an embodiment of a system for deliquifying a commingled well.

Referring now to FIG. 4, an embodiment of a system 200 for deliquifying a well 60 with three producing formations 61, 62, 63 is shown. System 200 is similar to system 100 previously described. Namely, system 200 has a central or longitudinal axis 205, a first or upper end 200*a* coupled to wellhead 10 and a second or lower end 200*b* extending to accumulated liquids 22 in well 60. Annulus 40 is formed radially between system 200 and well surface casing 21 and production casing 22. Production casing 22 includes perforations 23, 24, 25 along producing formations 61, 62, 63, respectively.

System 200 also comprises an elongate production tubing string 210 extending between ends 200*a, b* and defining a through passage 211, a plunger 120 disposed in tubing string 210, a standing valve 130 disposed at lower end 200*b*, and a plurality of packers 140, each packer 140 disposed about tubing string 210 and axially positioned between ends 200*a, b*. In addition, system 200 includes a plurality of tubular mandrels 150 positioned in tubing string 110, each mandrel 150 including a check valve 160. Plunger 120, standing valve 130, packers 140, mandrels 150, and check valves 160 are the same as those previously described with regard to FIGS. 1-3. For purposes of the explanation below, the portion of passage 211 axially below plunger 120 is referred to as the lower passage section 211*a*, the portion of passage 211 axially above plunger 120 is referred to as upper passage section 211*b*, the portion of annulus 40 positioned axially between the bottom of wellbore 60 and the lowermost packer 140 is referred to as lower annulus section 40*a*, the portion of annulus 40 between packers 140 is referred to as intermediate annulus section 40*b*, and the portion of annulus 40 axially positioned between surface 15 and the axially uppermost packer 140 is referred to as the upper annulus section 40*c*.

Unlike wellbore 20 previously described, which includes only two production zones 31, 32, well 60 includes three producing formations 61, 62, 63. As previously described, (a) at least one check valve (e.g., check valves 160) is axially positioned proximal and axially above each packer (e.g., packer 140); (b) the standing valve (e.g., standing valve 130) is positioned axially below the lowermost packer; and (c) at least one check valve is positioned proximal (i.e., at a similar depth) each production zone and associated perforations axially above the lowermost packer. Consequently, in this embodiment, system 200 includes an additional packer 140 and additional check valves 160. In particular, one packer 140 is positioned axially between producing formations 61, 62, and the second packer 140 is positioned axially between producing formations 62, 63; standing valve 130 is positioned at second end 100*b* and axially below the lowermost packer 1401; and at least one check valve 160 is axially positioned proximal each producing formation 61, 62, 63 and associated perforations 23, 24, 25, respectively.

Referring still to FIG. 4, commingled well 60 may be deliquified in a similar manner as well 20 previously described. Prior to installation of system 200 downhole, the existing production tubing from wellbore 60 is pulled and removed from casing 21, 22. Once the existing tubing is removed, lower end 200*b* of system 200 is inserted into wellbore 60 and casing 21, 22, and system 200 is axially advanced downhole. System 200 is configured and positioned in wellbore 60 such that one packer 140 is axially disposed between production zones 61, 62; one packer 140 is axially disposed between production zones 62, 63; one check valve 160 is positioned proximal and axially above each packer 140; one check valve 160 is axially positioned proximal each production zone 61, 62, 63; and standing valve 130 is positioned axially below the axially lowermost packer 140.

Plunger 120 is coaxially disposed in tubing string 110 with valve 123 opened, and allowed to slide axially downward through passage 211 to lower end 200*b*. As previously described, plunger 120 is configured to close proximal lower end 200*b* and open proximal upper end 100*a*. Thus, when plunger 120 reaches lower end 200*b*, valve 123 closes. Valve 123 remains closed until it is triggered to open when it is pushed back to upper end 200*a* at the surface 15.

With packers 140 and check valves 160 positioned within wellbore 20 relative to production zones 61, 62, 63 as previously described, each packer 140 is radially expanded into production casing 22, thereby sealingly engaging tubing string 110 and production casing 22. As a result, the axially lower packer 140 restricts and/or prevents fluid communication between lower annulus section 40*a* and intermediate annulus section 40*b*, and the axially upper packer 140 restricts and/or prevents fluid communication between intermediate annulus section 40*b* and upper annulus section 40*c*. As a result, fluids entering each annulus section 40*a*, 40*b*, 40*c* is isolated from the other annulus sections 40*a*, 40*b*, 40*c*.

Referring still to FIG. 4, with packers 140 sealingly engaging tubing string 110 and production casing 22, wellbore 60 is shut in using surface valves 11. In particular, passage 211 is closed off at surface 15 and annulus 40 is closed off at surface 15 if it was not already closed off. Once wellbore 60 is shut-in, the natural pressure of production zones 61, 62, 63 is allowed to build over time. As previously described, for most applications, the shut-in period is preferably between 1 and 128 hours, more preferably between 10 and 36 hours, and even more preferably between 12 and 24 hours. If the pressure of one or more of production zones 61, 62, 63 is sufficient to keep running plunger 120 with minimal or no shut-in period, the shut-in period is preferably zero to 30 mins.

Alternatively, if the pressure of the upper production zone (e.g., production zone 63) is higher than the lower production zone (e.g., zone 61), the tubing string (e.g., tubing string 110) may be shut-in and re-opened following the shut-in period, however, the annulus (e.g., annulus 40) may remain open when the tubing string is shut-in (i.e., the annulus is not shut in). This will allow production of the upper production zone through the annulus to the surface during and after the tubing string is shut-in to reduce the potential for choking the lower production zone.

Upper annulus section 40*c* is in fluid communication with producing formation 63 via perforations 25, intermediate annulus section 40*b* is in fluid communication with producing formation 62 via perforations 24, and lower annulus section 40*a*, as well as the bottom of wellbore 60, is in fluid communication with production formation 61 via perforations 23. Since lower annulus section 40*a* is sealed by the axially lower packer 140 during the well shut-in, as the pressure of production zone 61 increases, the pressure in lower annulus section 40*a* and the bottom of wellbore 60 will also increase, thereby urging fluids (e.g., accumulated liquids, water, produced hydrocarbons, etc.) through relatively low cracking pressure standing valve 130 and into tubing string 210. In addition, since upper annulus section 40*c* is sealed at its upper end with surface 15 with valves 11 and sealed at its lower end with the axially upper packer 140 during the well shut-in, as the pressure of production zone 63 increases, pressure in upper annulus section 40*c* will also increase, thereby urging fluids through relatively lower cracking pressure check valves 160 into tubing string 210. Still further, since intermediate annulus section 40*b* is sealed between packers 140 during the well shut-in, as the pressure of production zone 62 increases, pressure in intermediate annulus section 40*b* will also increase, thereby urging fluids through relatively lower cracking pressure check valves 160 into tubing string 210.

During the well shut-in, valve 123 of plunger 120 remains closed, and thus, fluid is restricted and/or prevented from flowing axially through bore 122 between upper annulus section 211*b* and lower annulus section 211*a*. Further, as previously described, plunger 120 sealingly engages the inner surface of tubing string 110. Thus, fluid is also restricted from flowing axially between tubing string 210 and plunger 120. In other words, as long as valve 123 of plunger 120 is closed, fluid in upper passage section 211*b* is isolated from fluid in lower passage section 211*a*.

After the shut-in period, tubing string 210 is opened at the surface 15. Once tubing string 210 is opened at upper end 200*a*, the pressure in upper passage section 211*b* is relieved, and thus, the axially downward forces acting on plunger 120 are significantly reduced. As a result, the built-up pressure in lower annulus section 211*a* begins to move plunger 120 axially upward through tubing string 210. Simultaneously, the built-up pressure in production zone 61, lower annulus section 40*a*, and the bottom of wellbore 60 forces fluid through standing valve 130 and into lower passage section 211*a*, further aiding in the lifting of plunger 120 to the surface 15. As plunger 120 move axially upward within tubing string 210, it pushes the slug of fluid in upper annulus section 211*b* axially upward to the surface 15.

When plunger 120 reaches the surface 15, valve 123 opens. If plunger 120 is not captured at the surface 15 and valve 123 is open, plunger 120 will fall axially downward through tubing string 210 to lower end 200*b*, at which point valve 123 closes, and the process may be repeated. Alternatively, plunger 120 may be captured at surface 15 to allow continued, unrestricted production of fluids (e.g., water, hydrocarbons, condensate, etc.) through tubing string 210 via the natural pressure of production zones 61, 62, 63. Such production from wellbore 60 may continue until liquid build-up kills the well in. Once production through tubing string 210 is sufficiently reduced or ceases, the process may be repeated by releasing plunger 120 into tubing string 210 with valve 123 open, thereby allowing plunger 120 to fall within tubing string 210 to lower end 200*b*, at which point valve 123 closes. Next, tubing string 210 and annulus 40 (if not already closed off) are shut in at the surface 15 with valves 11. During the shut-in, natural reservoir pressure is allowed to build, and then tubing string 210 is opened at the surface 15, and plunger 120 is forced to the surface 15 once again.

In the manner described, embodiments of systems and methods described herein (e.g., system 100, 200, etc.) utilize the natural built-up of pressure of the lowermost production zone to provide a simple and cost effective means to deliquify the wellbore, and further, utilize the natural build-up of pressure of all the production zones to produce fluids from each of the production zones. In addition, embodiments described herein allow isolation of separate production zones while allowing produced fluids from the separate production zones to flow through a single tubing string. The isolation of separate production zones also enables the separate treatment of production zones. For example, the uppermost production zone can be treated through the annulus and the lowermost production zone can be treated through the tubing string. For example, the standing valve may be removed with a wireline to perform a chemical batch, and then re-installed on the lower end of the tubing string following the treatment. The operator can initially swab the spend chemicals if formation pressure is low/depleted, or alternatively, if formation pressure is sufficient, the plunger can be employed to lift the spend chemical in batches to the surface.

Further, as embodiments described herein rely on natural reservoir pressure, the added expense and complexity of injecting pressurized fluid(s) into the annulus to produce fluids through the tubing string is eliminated. By employing a series of relatively low cracking pressure check valves along tubing string, fluid can be produced through the tubing string without having to be forced down to the bottom of the well, through standing valve 130, and then back up the tubing string to the surface.

Although embodiments described herein (e.g., system 100, 200) are shown as implemented in a cased borehole, they may also be employed in uncased boreholes. Moreover, although the wellbores shown in FIGS. 1 and 4 are generally straight, vertical wellbores, embodiments described herein may be used in shallow, deep, deviated, horizontal wells, or combinations thereof.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A method for removing fluids from a commingled well extending through a formation with a first production zone and a second production zone spaced apart from the first production zone, the method comprising:

(a) positioning a fluid removal system in the commingled well, wherein the system has a longitudinal axis, an upper end proximal the surface, and a lower end opposite the upper end and positioned in the commingled well; wherein the system comprises: a tubing string extending between the upper end and the lower end and having an inner flow passage extending between the upper end and the lower end; a plunger disposed in the inner flow passage; a plurality of check valves coupled to the tubing string, wherein each check valve allows one-way fluid flow from an annulus formed between the tubing string and the formation to the inner flow passage of the tubing string;

(b) sealing the first formation from the second formation in the annulus;

(c) shutting in the annulus at the surface;

(d) closing off the inner flow passage of the tubing string at the upper end for a period of time;

(e) allowing the pressure of the first production zone and the pressure of the second production zone to build up naturally over the period of time;

(f) flowing a produced fluid from the first production zone through a first of the plurality of check valves into the inner flow passage of the tubing string;

(g) flowing a produced fluid from the second production zone through a second of the plurality of check valves into the inner flow passage of the tubing string and pushing the produced fluid from the second production zone in the inner flow passage with the plunger;

(h) re-opening the inner flow passage of the tubing string at upper end after (e); and (i) lifting the produced fluid from the first production zone and the produced fluid from the second production zone in the inner flow passage to the surface during (h).

2. The method of claim 1, wherein the system further comprises a packer disposed about the tubing string, wherein the packer is axially disposed between the first production zone and the second production zone; and wherein (b) further comprises using the packer to seal the first production zone from the second production zone in the annulus.

3. The method of claim 2, wherein at least one check valve is positioned proximal and axially above the packer.

4. The method of claim 1, wherein the first of the plurality of check valves is axially positioned proximal the first production zone and the second of the plurality of check valves is axially positioned proximal the second production zone.

5. The method of claim 4, wherein the first of the plurality of check valves is a standing valve disposed at the lower end of the system.

6. The method of claim 1, wherein the period of time ranges from 1 hour to 72 hours.

7. The method of claim 1, wherein each check valve has a cracking pressure less than 5 psi.

8. The method of claim 1, wherein the tubing string comprises a plurality of tubular mandrels, and wherein at least one of the plurality of check valves is coupled to each of the mandrels.

9. The method of claim 1, wherein the commingled well further comprises a third production zone, and wherein (b) further comprises sealing each production zone from the other production zones in the annulus.

10. The method of claim 1, wherein the produced fluid from the first production zone in the inner flow passage is axially disposed below the plunger, and the produced fluid from the second production zone in the inner flow passage is axially disposed above the plunger.

11. A system for deliquifying a commingled well, the system having a longitudinal axis, a first end, and a second end opposite the first end, the system comprising: a tubing string defining an inner flow passage extending from the first end to the second end, wherein the tubing string includes a plurality of tubular mandrels; a plunger disposed within the inner flow passage, wherein the plunger slidingly engages the tubing string and is adapted to travel axially through the tubing string from the first end to the second end; a first packer disposed about the tubing string; a plurality of check valves, wherein each check valve is adapted to allow fluid flow into the inner flow passage, wherein at least one check valve is coupled to each tubular mandrel; a standing valve coupled to the tubing string proximal the second end; and wherein the packer is axially positioned between the standing valve and each check valve.

12. The system of claim 11, further comprising a second packer, wherein the second packer is axially positioned between two check valves.

13. The system of claim 11, wherein each check valve and the standing valve has a cracking pressure below 5 psi.

14. A method for removing fluids from a commingled well extending through a formation with a first production zone and a second production zone spaced apart from the first production zone, the method comprising:

(a) positioning a production tubing system in the commingled well, wherein the production tubing system extends along a longitudinal axis between a first end and a second end opposite the first end, the system comprising: an elongate tubing string with an inner flow passage; a plunger disposed in the inner flow passage; a plurality of axially spaced check valves coupled to the tubing string; and a first packer disposed about the tubing string;

(b) forming an annulus between the production tubing system and the formation;

(c) positioning the packer between the first production zone and the second production zone; (d) radially expanding the packer to dividing the annulus into an upper annulus section disposed above the packer and a lower annulus section disposed below the packer, the packer sealing the upper annulus section from the lower annulus section;

(e) closing off the annulus and the inner flow passage at the first end for a period of time;

(f) flowing a first fluid from the first production zone into the upper annulus section, the first fluid in the upper annulus section having a first pressure;

(g) flowing a second fluid from the second production zone into the lower annulus section, the second fluid in the lower annulus section having a second pressure;

(h) allowing the first pressure and the second pressure to increase naturally during (e);

(i) re-opening the tubing string at the first end;

(j) using the first pressure to flow the first fluid through a first of the check valves into the inner flow passage and using the second pressure to flow the second fluid through a second of the check valves into the inner flow passage; and (k) pushing the first fluid through the inner flow passage with the plunger; and pushing the plunger through the inner flow passage with the second fluid.

15. The method of claim 14, further comprising: (k) moving the first fluid and the second fluid through the inner flow passage to the first end.

16. The method of claim 15, wherein the first of the check valves is axially positioned proximal the first production zone and the second of the plurality of check valves is axially positioned proximal the second production zone.

17. The method of claim 14, wherein the period of time ranges from 1 hour to 72 hours.

18. The method of claim 14, wherein each check valve has a cracking pressure less than 5 psi.

19. The method of claim 14, wherein the production tubing system further comprises a standing valve disposed proximal the second end, the standing valve having a cracking pressure less than 5 psi.

* * * * *